US009017181B2

(12) United States Patent
Evans

(10) Patent No.: US 9,017,181 B2
(45) Date of Patent: Apr. 28, 2015

(54) GOLF FLAG PIN WITH COLLAPSIBLE SUPPORT

(71) Applicant: Gregory A. Evans, Homer Glen, IL (US)

(72) Inventor: Gregory A. Evans, Homer Glen, IL (US)

( * ) Notice: Subject to any disclaimer, the term of this patent is extended or adjusted under 35 U.S.C. 154(b) by 88 days.

(21) Appl. No.: 13/971,627

(22) Filed: Aug. 20, 2013

(65) Prior Publication Data

US 2015/0057094 A1 Feb. 26, 2015

(51) Int. Cl.
*A63B 57/00* (2006.01)
*G09F 17/00* (2006.01)

(52) U.S. Cl.
CPC ..... *A63B 57/0056* (2013.01)

(58) Field of Classification Search
USPC ..... 473/173–178; 248/166, 168–171; 116/173
See application file for complete search history.

(56) References Cited

U.S. PATENT DOCUMENTS 575,529 A * 1/1897 Stephens ..... 280/300
663,761 A * 12/1900 Johnson ..... 473/176
846,552 A * 3/1907 Collins et al. ..... 248/96
1,408,876 A * 3/1922 Frey ..... 206/315.3
2,751,176 A * 6/1956 Mowry ..... 248/96
3,632,073 A * 1/1972 Nakatani ..... 248/169
4,121,799 A * 10/1978 Michio ..... 248/171
4,317,553 A * 3/1982 Meinunger ..... 248/171
4,355,779 A * 10/1982 Heled ..... 248/460
5,222,705 A * 6/1993 Gibran et al. ..... 248/170
5,421,549 A * 6/1995 Richards ..... 248/163.2
5,482,247 A * 1/1996 Smith ..... 248/688
6,029,599 A * 2/2000 Hiltner, Jr. ..... 116/173
6,955,609 B1 * 10/2005 Hiltner et al. ..... 473/176
7,487,948 B2 * 2/2009 Gardner ..... 248/688
8,858,353 B2 * 10/2014 Wiggins et al. ..... 473/176
2003/0102414 A1 * 6/2003 Smart ..... 248/170
2005/0011999 A1 * 1/2005 Smart et al. ..... 248/170

* cited by examiner

*Primary Examiner* — Mark Graham
(74) *Attorney, Agent, or Firm* — Davis M. Chin, Jr.; Davis Chin

(57) ABSTRACT

A collapsible support assembly is provided, which is adapted for use with a golf flag pin in order to easily maneuver between a collapsed vertical position and an uncollapsed extended position. The collapsible support assembly includes an actuating sheath member, which, in combination with biasing means, is capable of extending or retracting a first leg and a second leg, so as to support the golf flag pin above the ground when in the extended position. The collapsible support assembly also includes a movable leg ring and a fixed leg ring, which is adaptable for attachment to the golf flag pin.

20 Claims, 3 Drawing Sheets

GOLF FLAG PIN WITH COLLAPSIBLE SUPPORT

BACKGROUND OF THE INVENTION

1. Field of the Invention

This invention relates generally to golf flag pins, and more particularly, the present invention relates to a collapsible support assembly, with extendable and retractable legs, which is adaptable for use on a golf flag pin.

2. Description of the Prior Art

For the past decade or so, golf has made a reemergence, particularly in the United States, as an extremely popular sport. The concept of the game is fairly simple. A player begins the game by teeing up his golf ball and driving it down the fairway toward the green. The intent is to hit the ball into a recessed hole, which is strategically located on the green. Ultimately, the player's objective is to hit the ball into the hole in the least amount of shots possible, so ideally, the player would like to hit the ball into the hole on the first try, but this rarely occurs.

Because the distance from the tee to the hole is usually quite long, the golf course places a golf flag pin in the hole, so that the player will be able to aim at a visible target. Typically, when the ball finally reaches the green the player removes the golf flag pin, places it onto the green and attempts to putt the ball into the hole. As stated before, the goal is to hit the ball into the hole in the fewest possible strokes. Because a typical eighteen-hole golf course has a par rating of seventy-two (a player can only hit the ball seventy-two times during the game to stay at par), putting is an essential part of the game due to the accuracy and precision it takes to hit the ball into the hole.

Many factors make putting a more difficult task than it appears to be at first glance. For instance, the player must consider the slope of the green, the speed at which the ball will travel on the green and the intended line of travel of the ball, to name a few. With these already built-in obstacles to the green, the player typically wants to avoid any other additional hazards during his putting. Thus, a player desires a smooth and uniformed green to putt on. However, this is not always the case because, as mentioned before, a player will remove the golf flag pin and place it onto the green prior to putting. Many times the player is not considerate and will throw the golf flag pin onto the green instead of gently placing the pin onto the green. This inconsiderate act usually causes many gouges on the green, creating a bumpy and difficult green to putt on for the next player by disturbing the line of travel of the ball to the hole.

Therefore, it is desirable to have a golf flag pin, which is capable of being self-supported above the surface of the green so as to eliminate the amount of damage to the green due to inconsiderate players dropping the golf flag pin onto the green and causing gouges.

A prior art search directed to the subject matter of this application in the U.S. Patent and Trademark Office revealed the following Letters Patent:

U.S. Pat. Nos. 663,761, 6,029,599 5,482,247, 6,955,609 5,492,430, 7,004,104 5,884,881

In addition to the above issued prior art utility patents, there was also found U.S. Patent Application Publication Nos. 2003/0102414 dated Jun. 5, 2003 to Smart and 2004/0198527 dated Oct. 7, 2004 to Hsieh.

For example, U.S. Pat. No. 6,955,609 to Harry F. Hiltner, Jr. et al. discloses a golf club and golf pin stand which includes a main body support bracket and a pair of leg members (FIG. 1) which, when attached to a golf pin, supports the golf pin above the ground in a tripod configuration. The main body support bracket is adapted to be connected to the shaft of the golf pin. The leg members are pivotally attached to the main body support bracket and move freely relative thereto between a retracted position when the golf pin is in a vertical position and an extended position when the golf pin is in a horizontal position.

Further, the patent to Hiltner, Jr., U.S. Pat. No. 6,029,599 teaches a golf pin stand device having a connector and a pair of leg members which, when attached to a golf pin, supports the golf pin above the ground in a tripod configuration. The connector is adapted to be connected to the shaft of the golf pin. The leg members are pivotally attached to the connector between a retracted position when the pin is in a vertical position and an extended position when the pin is in a horizontal position.

Furthermore, there is disclosed in U.S. Patent Application Publication No. 2003/0102414 to Smart a collapsible support which includes extendable and retractable arms and legs for generating an uncollapsed and collapsed state. In the uncollapsed state, the support can be placed on most types of surfaces in an upright position to support a golf club or other items by leaning the item against the arms or hanging the item from the arms. In the collapsed state, the arms and legs are substantially parallel and adjacent to the support's body and is thus easily transported or stored. Additionally, the support includes an arm attachment assembly, which is attached to the body, and a leg attachment assembly, which is attached to the body, both operable to extend and retract the respective arms and legs. There is also provided a biasing member (spring) to bias the arms and legs in a retracted position, an actuating member to extend the arms and legs, and a locking mechanism to lock the arms and legs in the extended position.

In particular as shown in FIG. 3, the leg attachment assembly includes a moving leg ring, which is attached to an inner tube, a fixed leg ring, which is attached to an outer tube, and leg links each having a leg end pivotally attached to the leg and a ring end pivotally attached to the fixed leg ring. The spring can be compressed between the moving leg ring and the fixed leg ring.

Finally, U.S. Pat. No. 663,761 to Johnson discloses a supporting attachment for a golf-flag which includes two corresponding arms having their outer ends bent upwardly to form feet so as to prevent the ends of the arms from being caught in the turf. The inner ends of the arms are secured to a sleeve-like swivel, which is arranged to turn freely between the collars, which are disposed on the ends of a sleeve.

The remaining patents, listed above but not specifically discussed, are deemed to be only of general interest and show the state of the art in golf pin stands.

Although the prior art discussed above attempt to support a golf flag pin, when not in the hole, above the surface of the green, many of the devices are heavy, awkward to use and present the problem of pinching fingers when engaging the device. Further, none of the prior art discussed above discloses a collapsible support assembly, adaptable for use with a golf flag pin, with an actuating sheath member, operable to extend retractable legs so as to support the pin above the surface of the green.

SUMMARY OF THE INVENTION

Accordingly, it is a general object of the present invention to provide a collapsible support assembly, which is easily adaptable for use with a golf flag pin and is capable of supporting the pin above the surface of the ground so as to reduce the amount of gouges inflicted onto the green from careless players who drop the pin onto the green.

It is an object of the present invention to provide a collapsible support assembly, which is adaptable for use with a golf flag pin, so as to eliminate the need for a golf player to bend over and pick up the golf flag pin from the surface of the green.

It is another object of the present invention to provide a collapsible support assembly, which is adaptable for use with a golf flag pin, so as to prolong the life span of the flag.

It is still another object of the present invention to provide a collapsible support assembly, which is adaptable for use with a golf flag pin, and that is easy, safe and time efficiently convenient to use during a round of golf.

In a preferred embodiment of the present invention, there is provided a collapsible support assembly, which is adapted for use with a golf flag pin in order to easily maneuver between a collapsed vertical position and an uncollapsed extended position. The collapsible support assembly includes an actuating sheath member, a first leg, a second leg, biasing means, a movable leg ring and a fixed leg ring, which is adaptable for attachment to the golf flag pin. Biasing means, for moving the first and second legs between an extended position and a retracted position when the actuating sheath member engages the biasing means, is operably connected to the fixed leg ring.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
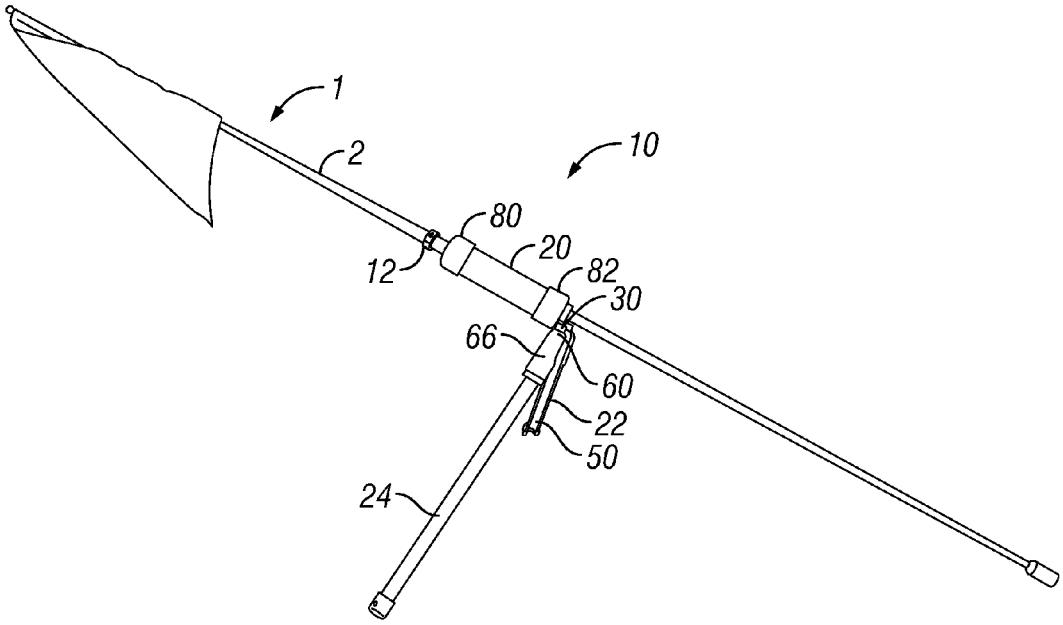
FIG. 1 is a perspective view of the collapsible support assembly 10 of the present invention, connected to a golf flag pin 1, illustrating the uncollapsed state with the legs in an extended position.
Figure 5:
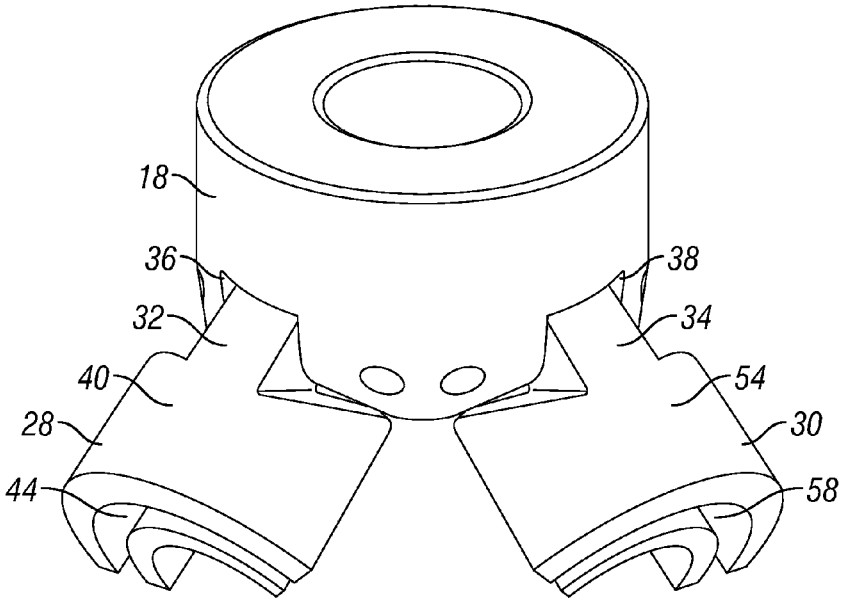
FIG. 5 is a top perspective, close-up view of the fixed leg ring 18 of the collapsible support assembly 10.

It is to be distinctly understood at the outset that the present invention shown in the drawings and described in detail in association with a collapsible support assembly, with extendable and retractable legs, which is adaptable for use on a golf flag pin, is not intended to serve as a limitation upon the scope or teachings thereof, but is to be considered merely for the purpose of convenience of illustration of one example of its application.

Referring now in detail to the drawings, wherein like reference characters designate like or corresponding parts throughout the several views, there is illustrated in FIGS. 1 through 6 a collapsible support assembly 10, with extendable and retractable legs, which is adaptable for use on a golf flag pin 1, constructed in accordance with the principles of the present invention.

Figure 2:
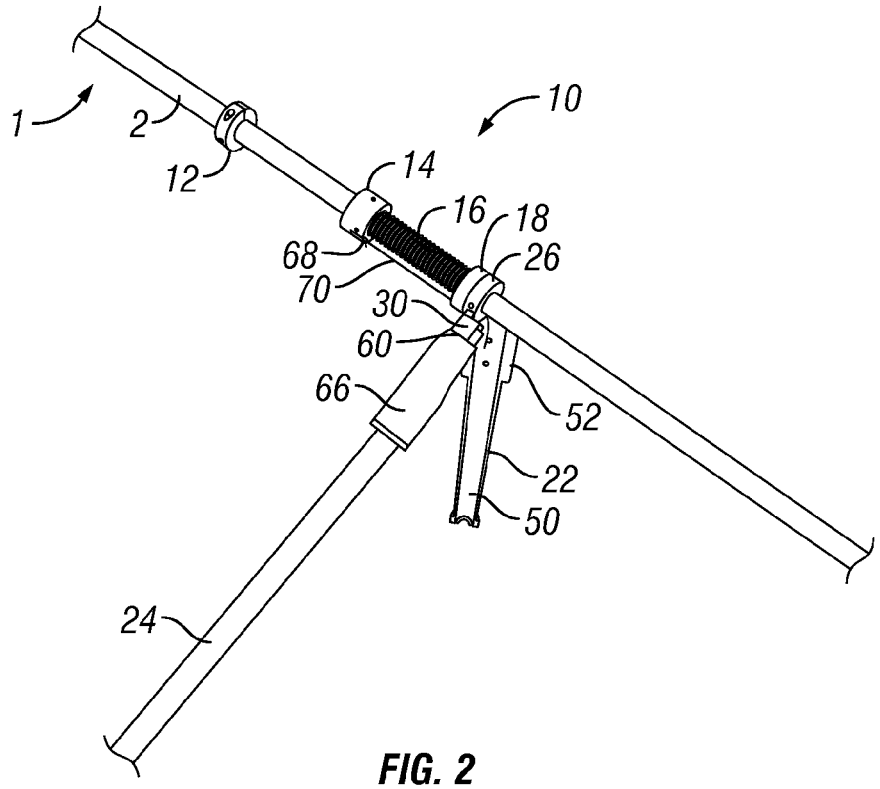
FIG. 2 is a perspective view of the collapsible support assembly 10 of the present invention, connected to a golf flag pin 1, illustrating the uncollapsed state with the legs in a retracted position and with the actuating sheath member 20 removed to illustrate in detail the other elements of the collapsible support assembly 10.
Figure 6:
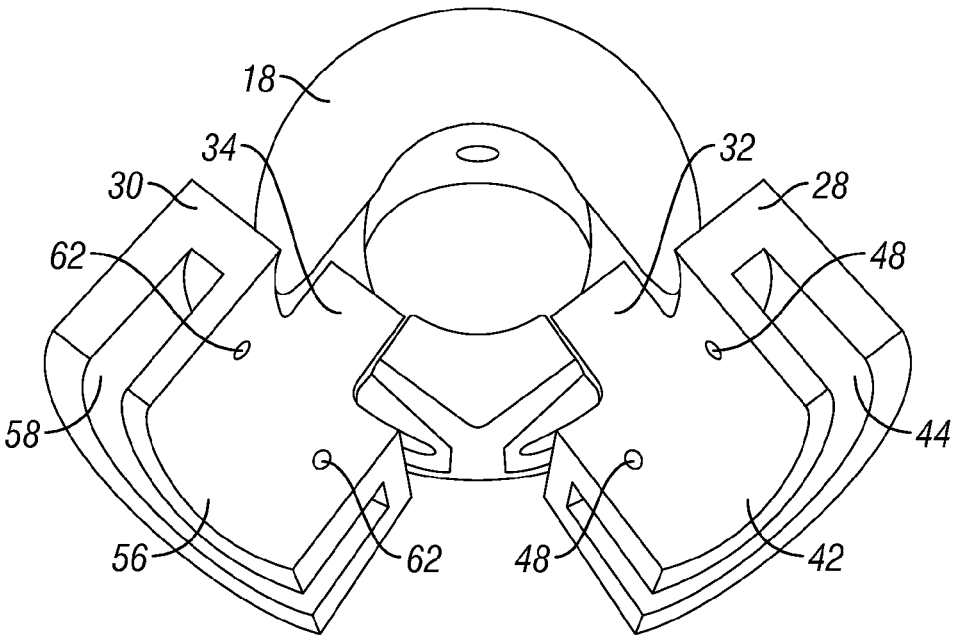
FIG. 6 is a bottom perspective, close-up view of the fixed leg ring 18 of the collapsible support assembly 10.
Figure 3:
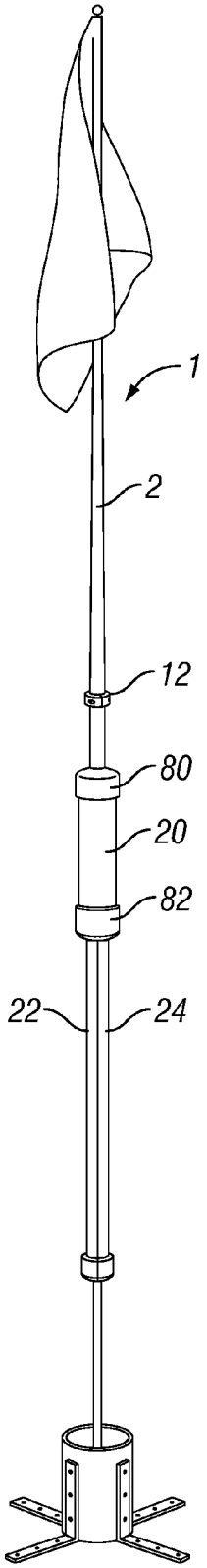
FIG. 3 is a perspective view of the collapsible support assembly 10 of the present invention, connected to a golf flag pin 1, illustrating the collapsed state with the legs in a retracted position.
Figure 4:
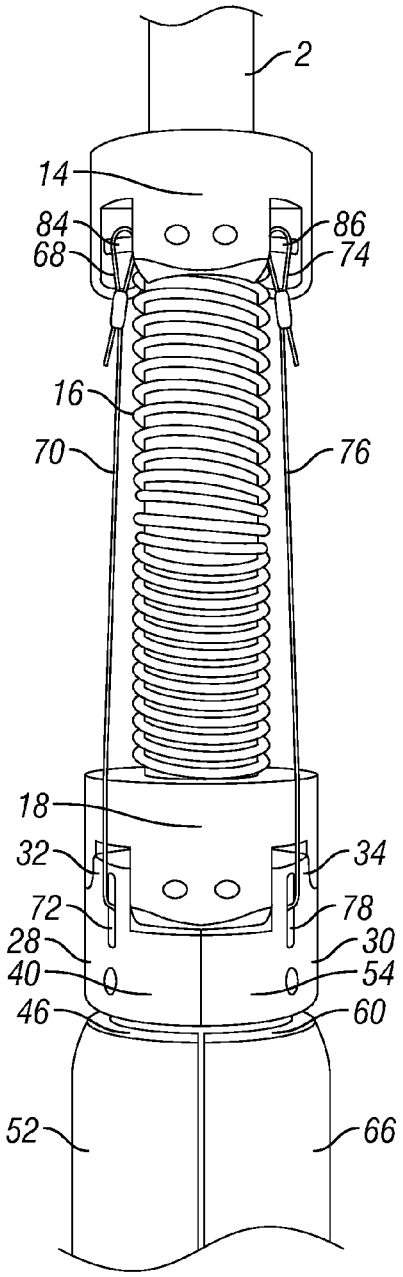
FIG. 4 is a detailed perspective view showing in detail the collapsible support assembly 10, with the actuating sheath member 20 removed, and in the collapsed state with the legs in a retracted position, of the present invention.

As shown in FIGS. 1-3, a collapsible support assembly 10 is adapted for use to a shaft 2 of a golf flag pin 1. The collapsible support assembly 10 includes a stop ring 12, a movable leg ring 14, a spring 16, a fixed leg ring 18, an actuating sheath member 20, a first leg member 22 and a second leg member 24. FIGS. 1 and 2 depict the collapsible support assembly 10 in an uncollapsed state while FIG. 3 depicts the collapsible support assembly 10 in a collapsed state.

Referring to FIG. 2, the actuating sheath member 20 has been removed in order to illustrate in detail the other elements of the collapsible support assembly 10. Fixed leg ring 18 is securely attached to the shaft 2 of the golf flag pin 1 by a screw (not shown) inserted through a threaded aperture 26 centrally located on the outer periphery of fixed leg ring 18. It is entirely conceivable that other attachment means such as nut and bolt type fasteners or glue-based adhesives, to name a few examples, may be used instead to fixedly secure the fixed leg ring 18 to the shaft 2.

The fixed leg ring 18 is in a hinged association with a first arm 28 and a second arm 30. Both first arm 28 and second arm 30 have a finger 32 and 34, respectively. Located on the fixed leg ring 18 are slots 36 and 38 (shown in FIG. 5), which hingedly receive fingers 32 and 34, respectively, so that the arms 28,30 are operable to move between an extended position and a retracted position, relative to the shaft 2 of the golf flag pin 1, when the collapsible support assembly 10 is in an uncollapsed state and a collapsed state, respectively.

The first arm 28 has a substantially convex-shaped side 40 and a substantially concave-shaped side 42, which is contoured to fit closely to the shaft 2 when the collapsible support assembly 10 is in a collapsed state. Shown in more detail in FIGS. 4-6, located opposite finger 32 is a channeled groove 44, which securely receives the top end 46 of first leg member 22. The first leg member 22 is further secured to the channeled groove 44 by a set of screws (not shown), which are inserted through threaded holes 48 located on the concave-shaped side 42 of the first arm 28. Although screws are the preferred mode of attachment, first leg member 22 may be attached to the first arm 28 by snap-fit, adhesives or other conventional means of attachment.

The first leg member 22 has a substantially concave-shaped side 50, which is contoured to fit closely to the shaft 2 when the collapsible support assembly 10 is in a collapsed state. Located substantially near top end 46 of first leg member 22 is a protruding portion 52, which engages with the actuating sheath member 20.

Similarly, the second arm 30 also has a convex-shaped side 54 and a substantially concave-shaped side 56, which is contoured to fit closely to the shaft 2 when the collapsible support assembly 10 is in a collapsed state. Shown in more detail in FIGS. 4-6, located opposite finger 34 is a channeled groove 58, which securely receives the top end 60 of second leg member 24. The second leg member 24 is further secured to the channeled groove 58 by a set of screws (not shown), which are inserted through threaded holes 62 located on the concave-shaped side 56 of second arm 30. Although screws are the preferred mode of attachment, second leg member 24 may be attached to the second arm 30 by snap-fit, adhesives or other conventional means of attachment.

The second leg member 24 has a substantially concave-shaped side 64, which is contoured to fit closely to the shaft 2 when the collapsible support assembly 10 is in a collapsed state. Located substantially near top end 60 of second leg member 24 is a protruding portion 66, which engages with the actuating sheath member 20.

Moving forward and with reference to the various views of the figures, the movable leg ring 14 is positioned around the shaft 2 a predetermined distance above fixed leg ring 18 and is operable to move along the shaft 2, with respect to the fixed leg ring 18 and in accordance with the principles of the spring 16. The spring 16, for biasing the collapsible support assembly 10 to the collapsed state, is positioned around the shaft 2 and located between the movable leg ring 14 and the fixed leg ring 18. A first end 68 of a first wire 70 is disposed onto the movable leg ring 14 at a first pin 84 while a second end 72 of the first wire 70 is attached to the substantially convex-shaped side 40 of the first arm 28. Similarly, a first end 74 of a second wire 76 is disposed onto the moveable leg ring 14 at a second pin 86 while a second end 78 of the second wire 76 is attached to the substantially convex-shaped side 54 of the second arm 30. Although a first wire and second wire 70,76 have been described to link the movable leg ring 14 to the first and second arms 28,30, any suitable linking members may be used in place of the wires 70,76.

With reference to the actuating sheath member 20 as best shown in FIGS. 1 and 3, the actuating sheath member 20 is disposed concentrically around the shaft 2 and is cylindrical in shape and has a substantially circular radial cross section. When collapsible support assembly 10 is in the collapsed state protruding portion 52 and protruding portion 66 abuttingly engage one another around shaft 2 creating a measurable outer circumference, which is approximately larger than the circumference of the shaft 2 yet only a fraction slightly smaller than the inner circumference of the actuating sheath member.

As shown in FIG. 3, the actuating sheath member 20 is in slidable engagement with the protruding portion 52 of first leg member 22 and with the protruding portion 66 of second leg member 24, thus the substantially concave-shaped sides 50,64 of first and second leg members 22,24, respectively, are fitted closely in a snug relationship to the shaft 2. While in this collapsed state, a top end 80 of the actuating sheath member 20 rests on top of movable leg ring 14 to prevent the actuating sheath member 20 from moving any further down (away from the flag 3) the length of the golf flag pin 1.

When the actuating sheath member 20 is slid upwardly (toward the flag 3) and as the bottom end 82 of the sheath member 20 moves above the protruding portions 52,66 of first and second leg members 22,24, respectively, the potential energy stored in the spring 16 is released and first and second leg members 22,24 move to their extended, uncollapsed state (as shown in FIG. 1). Because the stop ring 12 is disposed onto the shaft 2 a set distance from the movable leg ring 14, the actuating sheath member 20 is prevented from moving any further up (toward the flag 3) the golf flag pin 1, ensuring that the collapsible support assembly 10 remains in the uncollapsed state, forming a tripod configuration with the first and second leg members 22,24 and the bottom end of the golf flag pin 1.

From this uncollapsed state, the sheath member 20 can be slid downward toward the bottom end of the golf flag pin 1 to retract the first and second leg members 22,24 and return the collapsible support assembly 10 to the collapsed state. As the sheath member 20 is slid downward, the bottom end 82 of the sheath member 20 engages with the protruding portions 52,56 of first and second leg members 22,24, respectively, forcing the first and second leg members to move back to the fitted, snug relationship with the shaft 2, while also forcing the movable leg ring 14 towards fixed leg ring 18, via first and second wires 70,76, causing the spring 16 to move back to a compressed state.

Although the preferred embodiment of the present invention as described above, discusses a collapsible support assembly adapted for use with a golf flag pin, in an alternative embodiment, the collapsible support assembly could be formed integrally with the golf flag pin as one unit.

From the foregoing detailed description, it can thus be seen that the present invention provides a collapsible support assembly, adaptable for use with a golf flag pin, with an actuating sheath member, operable to extend retractable legs so as to support the pin above the surface of the green of a golf course.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A golf flag pin with a collapsible support assembly comprising:

a golf flag pin having a shaft;

a fixed leg ring attached to said shaft;

first and second arms both being hingedly connected to said fixed leg ring;

a first leg attached to said first arm;

a second leg attached to said second arm;

a movable leg ring movably engaged with said shaft, first linking means for linking said movable leg ring to said first arm and second linking means for linking said movable leg ring to said second arm;

a biasing member being disposed between said movable leg ring and said fixed leg ring;

an actuating sheath member concentrically disposed around said shaft and operable to engage said biasing member so as to move said first leg and said second leg between an extended position and a retracted position; and a stop ring attached to said shaft and operably engaged with said actuating sheath member so as to restrict the movement of said actuating sheath member when said first leg and said second leg are in said extended position.

2. A golf flag pin with a collapsible support assembly as claimed in claim 1, wherein each of said first and second legs includes a protruding portion.

3. A golf flag pin with a collapsible support assembly as claimed in claim 1, wherein each of said first and second legs has a substantially concave-shaped side.

4. A golf flag pin with a collapsible support assembly as claimed in claim 3, wherein each of said first and second legs has a substantially convex-shaped side.

5. A golf flag pin with a collapsible support assembly as claimed in claim 4, wherein each of said first and second arms has a substantially concave-shaped side.

6. A golf flag pin with a collapsible support assembly as claimed in claim 5, wherein each of said first and second arms has a substantially concave-shaped side.

7. A golf flag pin with a collapsible support assembly as claimed in claim 6, wherein said first and second legs are positioned abuttingly and opposite to each other so as to fit substantially close to said shaft when in said retracted position.

8. A golf flag pin with a collapsible support assembly as claimed in claim 1, wherein said actuating sheath member is substantially cylindrical in shape.

9. A golf flag pin with a collapsible support assembly comprising:

a golf flag pin having a shaft;

a collapsible support assembly including an actuating sheath member, a first leg, a second leg and a fixed leg ring, said fixed leg ring being attached to said shaft; and biasing means for moving said first and second legs between an extended position and a retracted position when said actuating sheath member engages said biasing means, said biasing means being operably connected to said fixed leg ring.

10. A golf flag pin with a collapsible support assembly as claimed in claim 9, wherein said biasing means is a spring.

11. A golf flag pin with a collapsible support assembly as claimed in claim 9, wherein said first leg includes a protruding portion and said second leg includes a protruding portion.

12. A golf flag pin with a collapsible support assembly as claimed in claim 9, wherein said first leg has a substantially concave-shaped side and said second leg has a substantially concave-shaped side.

13. A golf flag pin with a collapsible support assembly as claimed in claim 12, wherein said first leg has a substantially convex-shaped side and said second leg has a substantially convex-shaped side.

14. A golf flag pin with a collapsible support assembly as claimed in claim 9, wherein said actuating sheath member is substantially cylindrical in shape.

15. A golf flag pin with a collapsible support assembly as claimed in claim 13, wherein said first leg and said second leg are positioned to fit substantially close to said shaft when in said retracted position.

16. A collapsible support assembly, which is adapted for use with a golf flag pin, comprising:

a fixed leg ring adaptable for attachment to a golf flag pin;

a first arm and a second arm both being hingedly connected to said fixed leg ring;

a first leg attached to said first arm;

a second leg attached to said second arm;

a movable leg ring adaptable for movable engagement with said golf flag pin, first linking means for linking said movable leg ring to said first arm and second linking means for linking said movable leg ring to said second arm;

a biasing member being disposed between said movable leg ring and said fixed leg ring; and an actuating sheath member adaptable to be concentrically disposed around said golf flag pin and operable to engage said biasing member so as to move said first leg and said second leg to an extended position and a retracted position.

17. A collapsible support assembly as claimed in claim 16, further including a stop ring adaptable for attachment to said golf flag pin and adaptable for operable engagement with said actuating sheath member so as to restrict the movement of said actuating sheath member when said first leg and said second leg are in said extended position.

18. A collapsible support assembly as claimed in claim 16, wherein said actuating sheath member is substantially cylindrical in shape.

19. A collapsible support assembly as claimed in claim 16, wherein said first leg includes a protruding portion and said second leg includes a protruding portion.

20. A collapsible support assembly as claimed in claim 16, wherein said first leg has a substantially concave-shaped side and said second leg has a substantially concave-shaped side so that said first leg and second leg will be positioned to fit substantially close to said golf flag pin when in said retracted position.

* * * * *